US009522795B2

(12) United States Patent
Fukuda

(10) Patent No.: US 9,522,795 B2
(45) Date of Patent: Dec. 20, 2016

(54) MEDIUM LOADING DEVICE AND IMAGE FORMING SYSTEM

(71) Applicant: Oki Data Corporation, Tokyo (JP)

(72) Inventor: Masahiro Fukuda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 222 days.

(21) Appl. No.: 14/473,665

(22) Filed: Aug. 29, 2014

(65) Prior Publication Data

US 2015/0060592 A1 Mar. 5, 2015

(30) Foreign Application Priority Data

Aug. 29, 2013 (JP) ..... 2013-177524

(51) Int. Cl.

*B65H 1/28* (2006.01)
*B65H 1/26* (2006.01)
*B65H 31/22* (2006.01)

(52) U.S. Cl.

CPC ..... *B65H 1/266* (2013.01); *B65H 31/22* (2013.01); *B65H 2301/4227* (2013.01); *B65H 2301/51212* (2013.01); *B65H 2405/115* (2013.01); *B65H 2405/1111* (2013.01); *B65H 2405/1117* (2013.01); *B65H 2405/3322* (2013.01); *B65H 2701/11312* (2013.01); *B65H 2801/06* (2013.01)

(58) Field of Classification Search

CPC ..... B65H 2407/21; B65H 2402/45
USPC .. 399/392, 393; 242/566, 548, 615; 271/162
See application file for complete search history.

(56) References Cited

U.S. PATENT DOCUMENTS 8,096,544 B2 * 1/2012 Kano ..... B65H 3/34 271/9.02
8,401,456 B2 * 3/2013 Kano ..... B65H 1/266 271/9.09
9,037,072 B2 * 5/2015 Matsumoto ..... B65H 1/04 399/361
2004/0012141 A1 * 1/2004 Hara ..... B65H 1/00 271/145
2004/0085426 A1 * 5/2004 Cuyler, Jr. ..... B41J 13/106 347/104

FOREIGN PATENT DOCUMENTS

JP 48-91676 U 2/1972
JP 05-80758 U 11/1993
JP 06-179529 A 6/1994
(Continued)

*Primary Examiner* — Sang Kim
(74) *Attorney, Agent, or Firm* — Muncy, Geissler, Olds & Lowe, P.C.

(57) ABSTRACT

A medium loading device that is arranged adjacent to an image forming apparatus that includes a medium supply roller that carries a medium, includes a medium guide part that has a guide surface along which the medium is guided toward the medium supply roller, and is arranged on an upstream side of the medium supply roller in a medium carrying direction; a medium end contact part that is arranged on an upstream side of the medium guide part in the medium carrying direction, is positioned below the guide surface of the medium guide part in the vertical direction, and is configured to contact an medium upstream end of the medium so that a portion of the medium is upwardly supported when the medium upstream end of the medium contacts the medium end contact part.

20 Claims, 10 Drawing Sheets

(56) References Cited

FOREIGN PATENT DOCUMENTS

| | | | |
|---|---|---|---|
| JP | 10-194468 | A | 7/1998 |
| JP | 2002-362786 | A | 12/2002 |
| JP | 2004-91211 | A | 3/2004 |

* cited by examiner

MEDIUM LOADING DEVICE AND IMAGE FORMING SYSTEM

CROSS REFERENCE

The present application is related to, claims priority from and incorporates by reference Japanese Patent Application No. 2013-177524, filed on Aug. 29, 2013.

TECHNICAL FIELD

The present invention relates to a medium loading device for a long medium and an image forming apparatus that adopts the medium loading device.

BACKGROUND

Conventionally in this type of medium loading device, a long sheet to be loaded is normally set in a rolled manner and supplied to an image forming apparatus (for example, JP Laid-open application publication 2002-362786, Paragraph 0020-0024, FIG. 6).

However, in the medium loading device having the above-described configuration, when long sheets are set in a pile, it is difficult that the sheets are smoothly supplied one by one because friction between adjacent parts is large.

A medium loading device disclosed in the application that is arranged adjacent to an image forming apparatus that includes a medium supply roller that carries a medium, includes a medium guide part that has a guide surface along which the medium is guided toward the medium supply roller, and is arranged on an upstream side of the medium supply roller in a medium carrying direction; a medium end contact part that is arranged on an upstream side of the medium guide part in the medium carrying direction, is positioned below the guide surface of the medium guide part in the vertical direction, and is configured to contact an medium upstream end of the medium so that a portion of the medium is upwardly supported when the medium upstream end of the medium contacts the medium end contact part.

According to the medium loading device of the present invention, it is possible that sheets are smoothly supplied one by one because friction generated between sheets is reduced.

DETAILED DESCRIPTION OF EMBODIMENTS

First Embodiment

Figure 1:
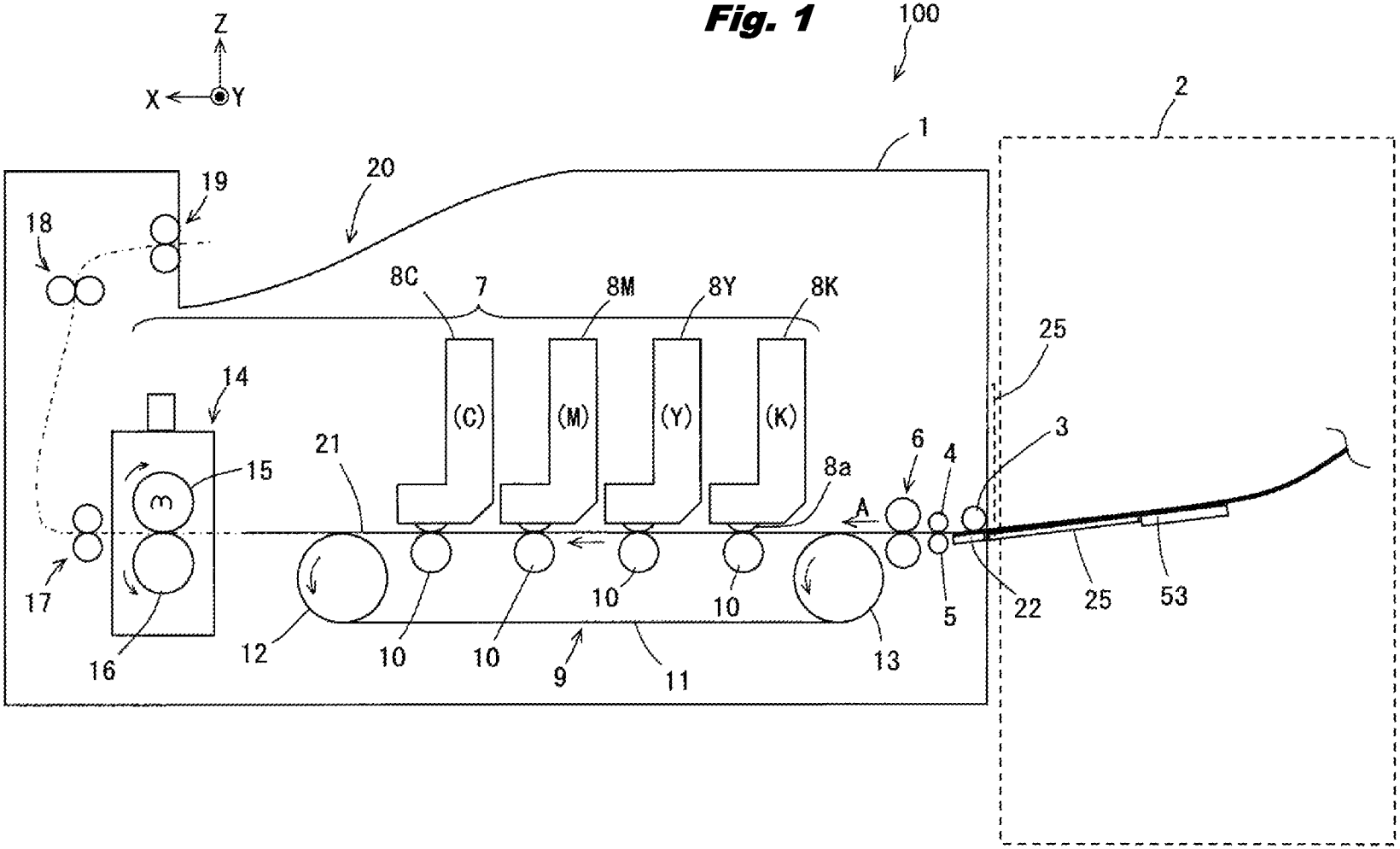
FIG. 1 is a schematic configuration view that explains a main body configuration of an image forming apparatus according to a first embodiment that adopts a medium loading device of the present invention.

FIG. 1 is a schematic configuration view that explains a main body configuration of an image forming apparatus 100 according to a first embodiment that adopts a medium loading device 2 of the present invention.

As illustrated in FIG. 1, the image forming apparatus 100 is configured with the medium loading device 2 and an image forming apparatus main body 1, and has a configuration as a color electrophotographic printer that is able to print with four colors: black (K); yellow (Y); magenta (M); and cyan (C). The medium loading device 2 is attached to the image forming apparatus main body 1 in a state where a front cover 25 of the image forming apparatus main body 1 is opened (closed state is illustrated with a broken line), and at the same time, a guide surface of a sheet supply plate 22, a guide surface of the front cover 25, and a guide surface of a base plate 53 of the medium loading device 2 are configured to be on a same plane in a state where the sheet supply plate 22 side is inclined slightly downward.

The sheet feed roller 3 (or medium supply roller) supplies a long sheet 21 set in the medium loading device 2 as described below. A feed roller 4 carries the supplied sheet 21 along a carrying path (illustrated in FIG. 1 by a dot-dash line) in an arrow A direction. A retard roller 5 is arranged facing the feed roller 4, and works to separate the long sheets 21 one by one, the sheets being supplied from the sheet supply roller 3. A registration roller pair 6 corrects skew of the carried long sheet 21 and carries the long sheet 21 to a further downstream side.

An image forming unit 7 in the image forming apparatus main body 1 is configured with four development units 8, a transfer unit 9, and a fuser unit 14. The four development units 8 includes, from an upstream side along the carrying path of the long sheet 21 in a following order, a development unit 8K that forms a toner image in black (K), a development unit 8Y that forms a toner image in yellow (Y), a development unit 8M that forms a toner image in magenta (M), and a development unit 8C that forms a toner image in cyan (C) (reference number 8 is given when there is no necessity to distinguish and the development units are collectively referred.)

The transfer unit 9 includes an endless-type transfer belt 11 that is formed of a conductive material, a drive roller 12 that is rotated by a not-illustrated drive part in an arrow direction and rotatably moves the transfer belt 11, an idler roller 13 that forms a pair with the drive roller 12 and stretches the transfer belt 11, and four transfer rollers 10 that are arranged to press and contact image carriers 8*a* of the four development units 8 via the transfer belt 11.

Onto the transfer roller 10, a high voltage is applied from a not-illustrated voltage generation part, the high voltage having a reversed polarity of a toner image formed on the image carrier 8*a* in an electrophotographic process in the corresponding development unit 8. The transfer belt 11 transmits the high voltage applied to the transfer roller 10 and sequentially transfers toner images formed on the image carriers 8*a* in the development units 8 in an overlapped manner on a surface of the long sheet 21 carried along the carrying path toward the down stream side (in the arrow direction).

The fuser unit 14 includes a fuser roller 15 that is heated by an incorporated fuser heat generator and rotates in the arrow direction and a pressure application roller 16 that is pressed to the fuser roller 15 by a not-illustrated pressing method and rotates. The fuser unit 14 holds the long sheet 21 on which the toner image is transferred by the transfer unit 9 with a press-contact part and carries the long sheet 21, and meanwhile fuses the toner image to the surface of the long sheet 21. A fuser and carrying roller pair 17 is located in the vicinity and on the downstream side of the fuser unit 14, and carries the fused long sheet 21 ejected from the fuser unit 14 to the downstream. The carrying roller pair 18 carries the long sheet 21 carried by the fuser and carrying roller pair 17 to a further downstream side along the carrying path. The ejection roller pair 19 ejects the long sheet 21 carried by the carrying roller pair 18 to a stacker part 20 of the image forming apparatus main body 1.

Note, regarding the X, Y and Z axes in FIG. 1, the X axis corresponds to a carrying direction that the long sheet 21 passes through the development units 8, the Y axis corresponds to a rotation shaft direction of the transfer rollers 10, and the Z axis corresponds to a direction orthogonal to both the X and Y axes. When X, Y and Z axes are illustrated in other figures, which will be described later, axis directions of the X, Y and Z axes correspond to those in FIG. 1. In other words, the X, Y and Z axes in the figures illustrates an arrangement direction when portions illustrated in the figures configure the image forming apparatus 100 illustrated in FIG. 1. Also, herein, the portions are arranged such that the Z axis corresponds to an approximately vertical direction.

Figure 2:
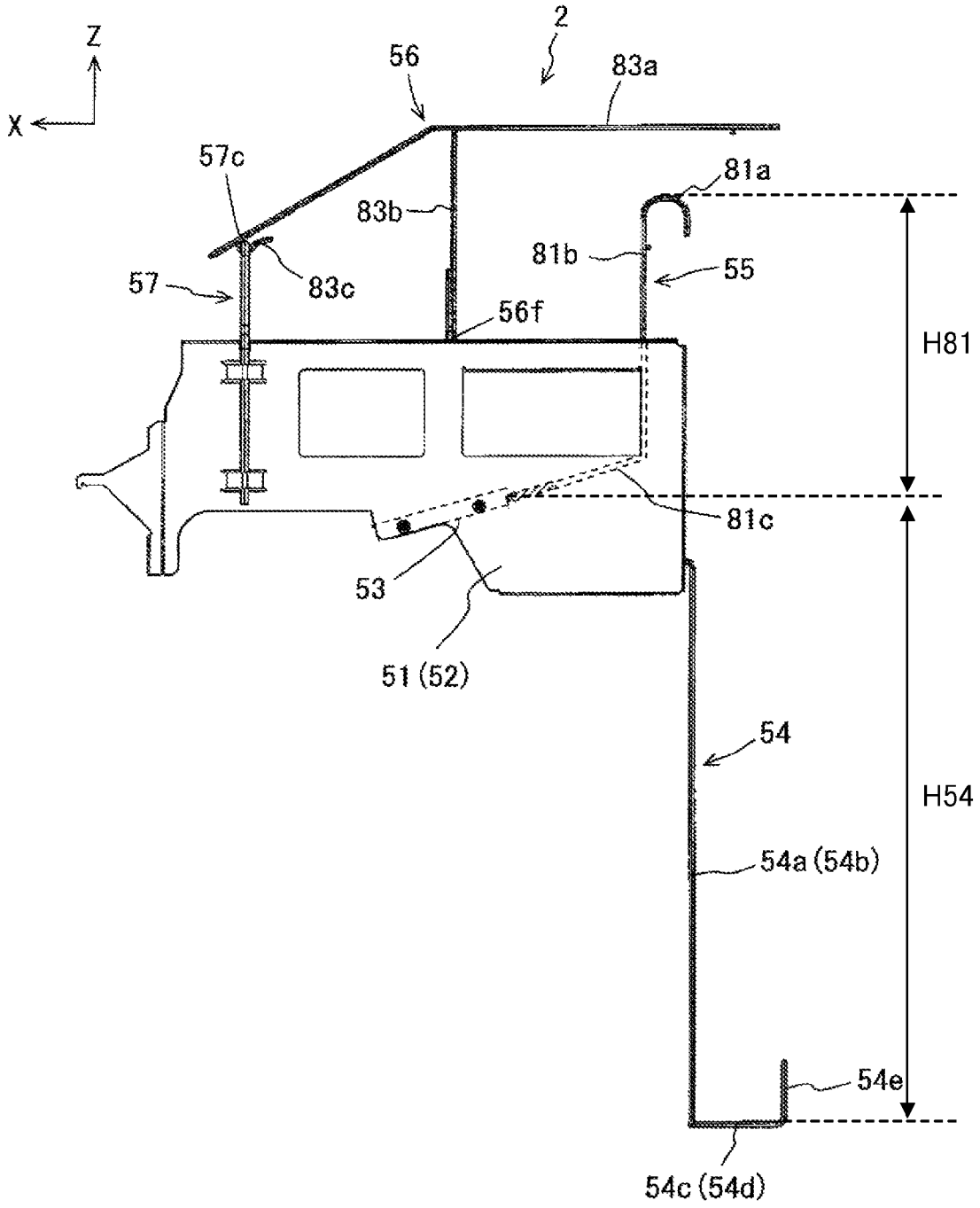
FIG. 2 is a side view of the medium loading device of the first embodiment.
Figure 3:
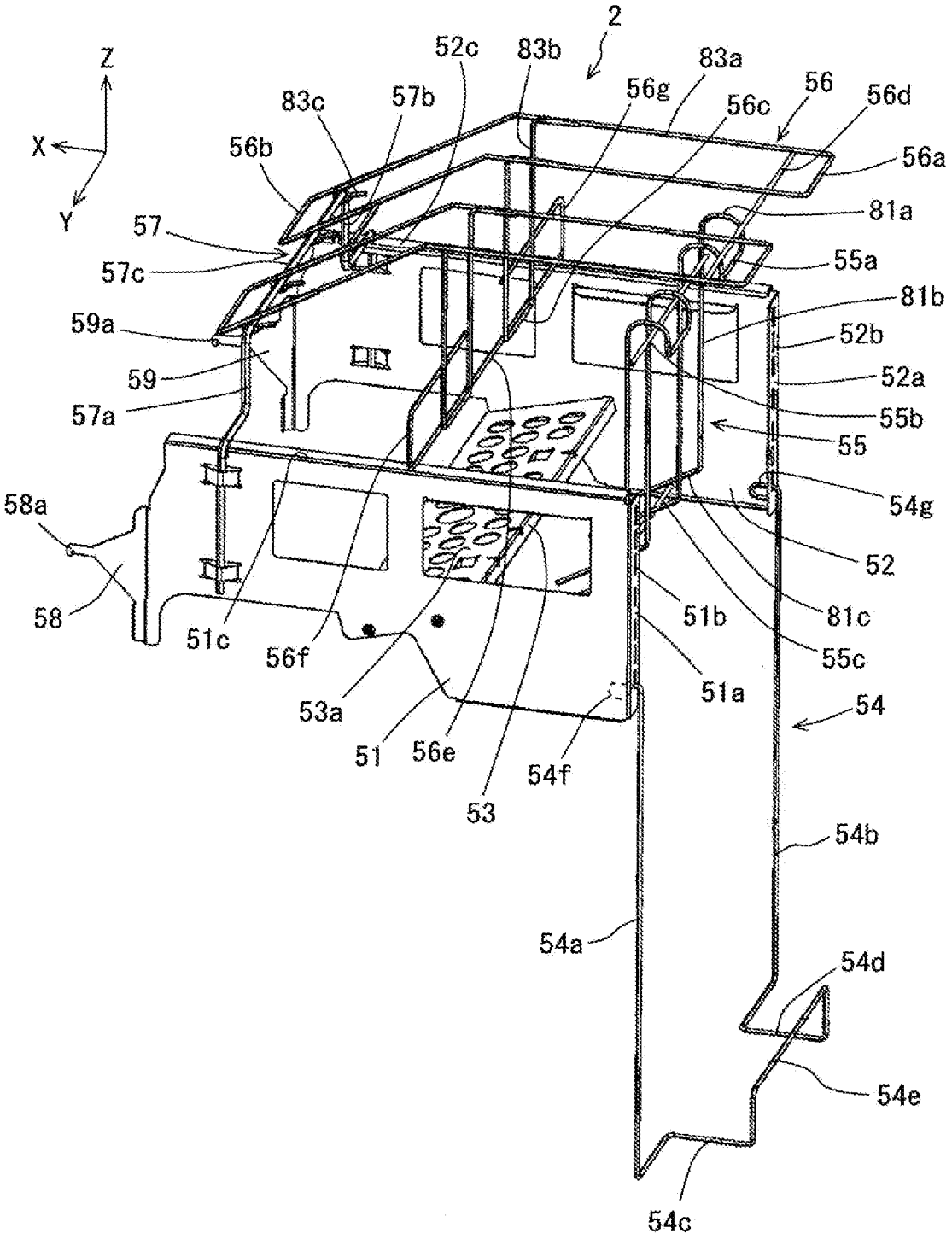
FIG. 3 is an appearance perspective view of the medium loading device according to the first embodiment.

Next, the medium loading device 2 is explained. FIG. 2 is a side view of the medium loading device 2 of the first embodiment of the present invention. FIG. 3 is an appearance perspective view of the medium loading device 2, viewed from an obliquely upper part.

As illustrated in the figures, the medium loading device 2 is configured with a left side plate 51, a right side plate 52, a base plate 53, a first guide 54, a second guide 55, a third guide 56, and a shaft 57.

The base plate 53 in a board shape as a medium guide part is arranged between the left side plate 51 and the right side plate 52 arranged on left and right sides as viewed from a front side (minus side of X axis), and both end parts of the base plate 53 are firmly attached to the left and right side plates 51 and 52. The left and right side plates 51 and 52 have a shape that is plane-symmetric to an imaginary center plane (in parallel to a X-Z plane) that is located in the middle between the side plates 51 and 52, and integrally hold the base plate 53 in a lower center part (in X axis direction) in a state that the base plate 53 is slightly inclined to the image forming apparatus main body 1 side (X axis plus side) with respect to a horizontal direction. A width of the base plate 53 is set to be wider than a width of the long sheet 21 to be set.

On respective end part surfaces 51*a* and 52*a* of the left and right side plates 51 and 52, the surfaces being formed in a manner of being extended in a perpendicular direction on a side (X axis minus side) opposite to the image forming apparatus main body 1, a plurality of attachment long holes 51*b* and 52*b* that are arrayed in perpendicular directions are formed at a constant pitch. On respective tip end parts of left and right projection parts 58 and 59 arranged on the image forming apparatus main body 1 side (X axis plus side), hook parts 58*a* and 59*a* that insert into insertion hollows 26 and 27 (see FIG. 4) formed in the image forming apparatus main body 1 are formed.

The first guide 54 as a medium contact holding part is formed by a processed piece of a metallic cylinder shape member, and is configured with engagement parts 54*f* and 54*g*, suspension parts 54*a* and 54*b*, locating parts 54*c* and 54*d* as medium end contact parts, and a link part 54*e*, which are formed in a connected manner. The engagement parts 54*f* and 54*g* that correspond to both end parts of the first guide 54 are detachably attached by inserting into a pair of the long holds 51*b* and 52*b* at the same height of the plurality of attachment long holes 51*b* and 52*b* that are formed at a constant pitch on the left and right side plates 51 and 52.

When the first guide 54 is attached to the left and right side plates 51 and 52, the suspension parts 54*a* and 54*b* of the first guide 54 extend vertically downward from the engagement parts 54*f* and 54*g*, and reach the locating parts 54*c* and 54*d* that bend in directions of getting close to each other and in a direction in parallel with the X axis minus side. The left and right locating parts 54*c* and 54*d* are connected to both end parts of the link part 54*e* extended vertically upward and having a U shape. Therefore, the locating parts 54*c* and 54*d* are located vertically lower than and on the X axis minus side of the base plate 53, and a height in the vertically direction of the first guide 54 is adjustable by selecting the long holds 51*b* and 52*b* at different height for attachment of the engagement parts 54*f* and 54*g*.

The second guide 55 as a medium supporting part is formed by a processed piece of a metallic cylinder shape member herein, and has a configuration that four guide pieces 81 are arranged in the width direction (Y axis direction) of the base plate 53. The guide piece 81 is formed with a front end guide part 81*a* as a contact part that is curved to have an almost semicircular shape, a supporting part 81*b*, and a connection part 81*c* in a connected manner. Thanks to the curved shape of the front end guide part 81*a*, a friction force generated against a sheet, which is carried over the part 81*a*, decreases. Also, smoothness of the sheet feeding is enhanced. A pair of the guide pieces 81 is linked to each other by a linkage part 55*a* at their front end guide parts 81*a*, and furthermore the four guide pieces 81 are fixed to fixing bars 55*b* and 55*c* and formed in an integrated manner. The front end guide part 81*a* is in a height of H81 from the guide surface of the base plate 53. The height H81 may be determined from a most upstream edge of any guide surface of, for example, the base plate 53, front cover 25, sheet feed plate 22.

Therefore, four tip guide parts 81*a* that are curved to have the almost semicircular shape are arranged in the width direction of the base plate 53, and thereby are arranged along an upper half part of circumference surface of a cylinder member. As described later, as the tip guide parts 81*a* function as almost the same as the cylinder member does, so that damage caused to the long sheet 21 may be reduced.

The second guide 55 is held by the base plate 53 herein. In the held state, the second guide 55 is positioned between the base plate 53 and the locating parts 54*c* and 54*d* of the first guide 54 in the X axis direction as illustrated in FIG. 2. In the front end guide part 81*a*, an end part thereof is positioned on the X axis minus side, and is arranged higher in the vertical direction than the locating parts 54*c* and 54*d* of the first guide 54 and the base plate 53. Also, the connection parts 81*c* of the second guide 55 are almost extended toward the base plate 53. Although not illustrated in FIG. 3, as illustrated in FIG. 2, out of the connection parts 81*c* of the second guide 55, the connection parts 81 located on both sides or all of the connection parts 81 are extended to the base plate 53 and held by the base plate 53.

A shaft 57 is formed by a processed piece of a metallic cylinder shape member. The shaft 57 is formed with supporting parts 57*a* and 57*b* and a linkage shaft part 57*c* in a connected manner. The supporting part 57*a* and 57*b*, as forming a symmetric pair, are formed in a crank shape and arranged in directions that respective upper parts thereof approach each other. The linkage shaft part 57*c* links end parts of the supporting parts 57*a* and 57*b*. The supporting parts 57*a* and 57*b* of the shaft 57 are respectively firmly supported by the left and right side plates 51 and 52 in the vicinities of end parts of the image forming apparatus main body 1 side (X axis plus side). Under the supported state, the linkage shaft part 57*c* is arranged to extend over an almost entire region of the base plate 53 in the width direction at a height position that is slightly lower than a height of the front end guide part 81*a* of the second guide 55.

The third guide 56 as the medium loading part is formed by a processed piece of a metallic cylinder shape member, and has a configuration that four guide pieces 83 are arranged in the width direction of the base plate 53. The guide piece 83 is formed with a loading guide part 83*a* that bends to have a dog leg shape, a supporting part 83*b* formed in a right angle shape from an almost center part of the loading guide part 83*a*, and a hook 83*c* provided at one end side of the loading guide part 83*a* in an integrated manner. In two guide pieces 83 that forms a pair in the guide pieces 83, end parts of the loading guide parts 83*a* and tip end parts of the supporting parts 83*b* are respectively linked by linkage parts 56*a*, 56*b*, and 56*c*. Furthermore, the third guide 56 is fixed by a fixing bar 56*d* that is suspended over all of the guide parts 83 in the vicinity of the linkage part 56*a* and a fixing bar 56*e* that is suspended over all of the guide parts 83 in a position of laying on the linkage part 56*c*, and therefore the third guide 56 is formed in an integrated manner.

The third guide 56 is revolvably supported by the shaft 57 when the hooks 83 fit on the linkage shaft part 57*c* of the shaft 57. Under the supported state, projection parts 56*f* and 56*g* of the fixing bar 56*e* respectively contact upper sides 51*c* and 52*c* of the left and right side plates 51 and 52 and this restricts revolve in a stationary state so that the third guide 56 stays at a reference revolve position. In the reference revolve position as illustrated in FIG. 2 and FIG. 3, the third guide 56 is formed and arranged such that a half part of the loading guide part 83*a* that is on a side (X axis minus side) opposite to the image forming apparatus main body 1 extends above the base plate 53 and the front end guide part 81*a* and extends more in an horizontal direction and the other half part of the loading guide part 83*a* that is on a side (X axis minus side) of the image forming apparatus main body 1 inclines downward from an upper part of the base plate 53 to the linkage shaft part 57*c* of the shaft 57.

Next, a procedure of attaching the medium loading device 2 to the image forming apparatus main body 1 and a procedure of setting the long sheet 21 into the medium loading device 2 are explained.

Figure 4:
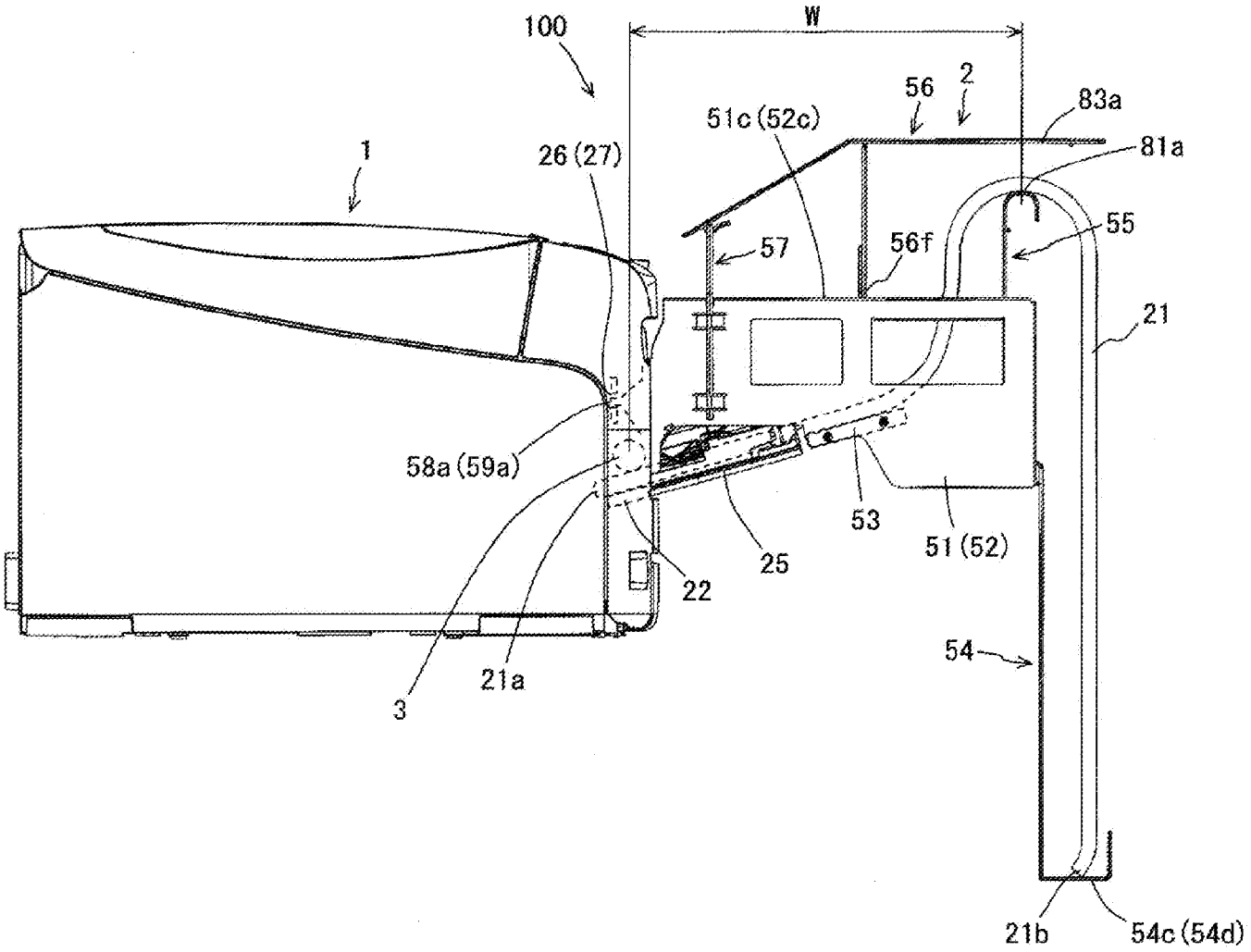
FIG. 4 is a state explanatory view of the medium loading device arranged adjacent to an image forming apparatus main body in a state where a long sheet is set.
Figure 5:
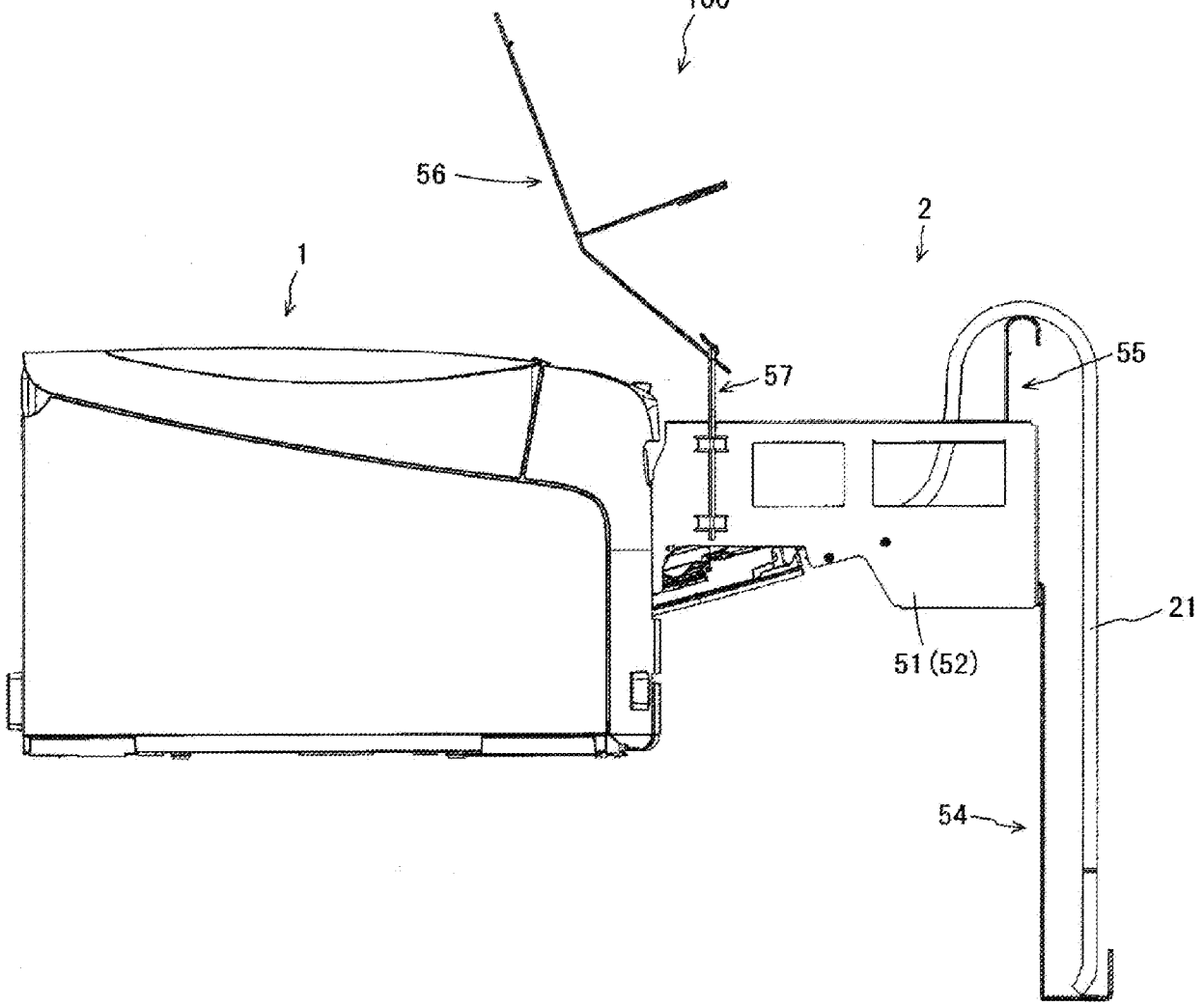
FIG. 5 is a state explanatory view that shows a state where a third guide is revolved to a retreat position with respect to the state in FIG. 4.
Figure 6:
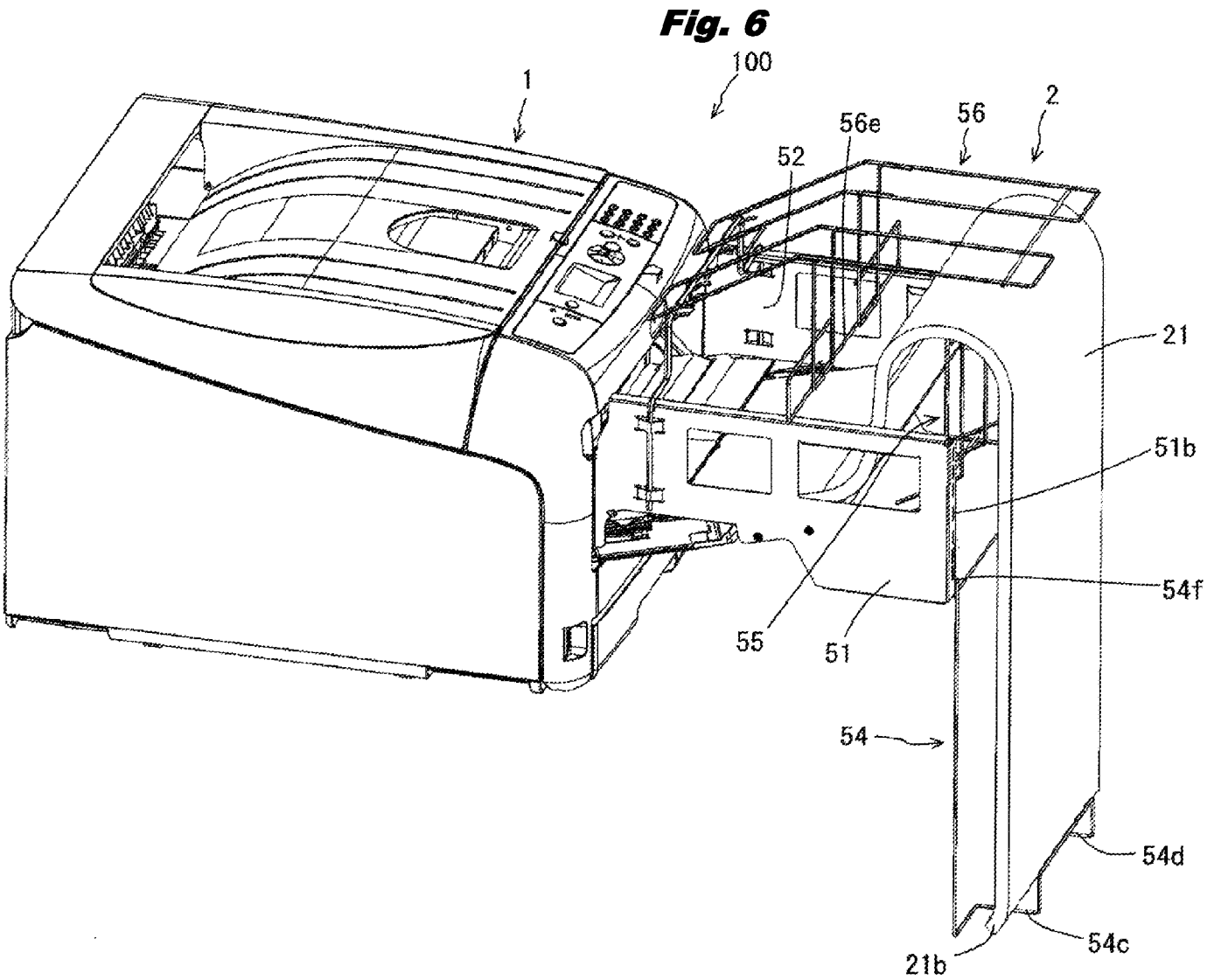
FIG. 6 is an appearance perspective view of the image forming apparatus according to the first embodiment when a long sheet is set, viewed from an obliquely upper part.

FIG. 4 is a state explanatory view of the medium loading device 2 arranged adjacent to the image forming apparatus main body 1 in a state where the long sheet 21 is set. FIG. 5 is a state explanatory view that shows a state where the third guide 56 is revolved to a retreat position. FIG. 6 is an appearance perspective view of the image forming apparatus 100 when the long sheet 21 is set, viewed from an obliquely upper part.

The medium loading device 2 is attached to the image forming apparatus main body 1 such that the hook parts 58*a* and 59*a* are respectively inserted into the insertion hollows 26 and 27 that forms a symmetric pair and is formed inside the image forming apparatus main body 1 of which the front cover 25 is opened, and is arranged in a front step thereof. At this time, the guide surface (upper surface) of the sheet supply plate 22 of the image forming apparatus main body 1, the guide surface (upper surface) of the front cover 25, and the guide surface 53*a* (see FIG. 3) of the base plate 53 of the medium loading device 2 are configured to be on a same plane in a state where the sheet supply plate 22 side is inclined slightly downward.

For example, when a pile of fifty sheets of the long sheets 21 is set in the medium loading device 2, at first as illustrated in FIG. 5, the third guide 56 is revolved to the retard position. At this time, the third guide 56 is restricted from revolving in an anticlockwise direction due to a self weight by a not-illustrated restriction member, and is maintained in the retard position as illustrated in FIG. 5.

In this state as illustrated in FIG. 4, a front end part 21*a* of the pile of the long sheets 21 is inserted between the sheet supply roller 3 and the sheet supply plate 22, a middle part of the pile is loaded on the arc-shaped front end guide part 81*a* of the second guide 55, and furthermore a rear end part 21*b* is set to contact the locating parts 54*c* and 54*d* of the first guide 54. At this time, a height of the first guide 54 is adjusted by the above-described way such that the rear end part 21*b* of the pile of the long sheet 21 contacts the locating part 54*c* and 54*d* in a slightly bent state. FIG. 4 shows a state where the third guide 56 is revolved to the reference revolve position after the long sheet 21 is set as described above. The height of the first guide 54 is defined H54, which is measured from a guide surface of the base plate to the locating part 54*c*. See FIG. 2. In the same fashion as the height H81, the height H54 may be determined from a most upstream edge of any guide surface of, for example, the base plate 53, front cover 25, sheet feed plate 22.

At this time, the front end part 21*a* of the long sheet 21 is held by the sheet supply roller 3 and the sheet supply plate 22, and then an upmost layer of the long sheet contacting the sheet supply roller 3 is able to be supplied. Note, the sheet supply plate 22 is biased such that the upmost layer of the long sheet 21 contacts the sheet supply roller 3 with a predetermined pressure force after the long sheet 21 is set, however a detail explanation of the configuration is omitted.

Accordingly, the locating parts 54*c* and 54*d* of the first guide 54 are positioned on an upstream side of the front end guide part 81*a* of the second guide 55 along the carrying direction of the long sheet 21. The front end guide part 81*a* of the second guide 55 is positioned on an upstream side of the base plate 53 along the carrying direction. The loading guide part 83*a* of the third guide 56 is above the set long sheet 21 in the vertical direction.

Under the state where the pile of the long sheet 21 is set in the medium loading device 2, the long sheet 21 is supported at the almost middle part by the arc-shaped front end guide part 81*a* of the second guide 55. As a result, a load of the pile of the long sheet 21 is reduced and friction among the long sheets 21 is reduced.

Furthermore, because the rear end part 21*b* of the long sheet 21 is pushed and bent by the locating parts 54*c* and 54*d* of the first guide 54, a load of the pile of the long sheet at the arc-shaped front end guide part 81*a* of the second guide 55 is reduced and friction among the piled long sheets 21 at the part is reduced.

As a result, a distance W between a rotation shaft of the sheet feed roller 3 and a top part of the front end guide part 81*a* of the second guide 55 is set to be shorter than a length L of the long sheet 21 to be supplied in the carrying direction, and more preferably the distance W is within 40% to 70% of the length L. Herein, the distance W is set to be 600 mm and a length of the long sheet 21 to be treated is set to be from 900 mm through 1320 mm.

Figure 7:
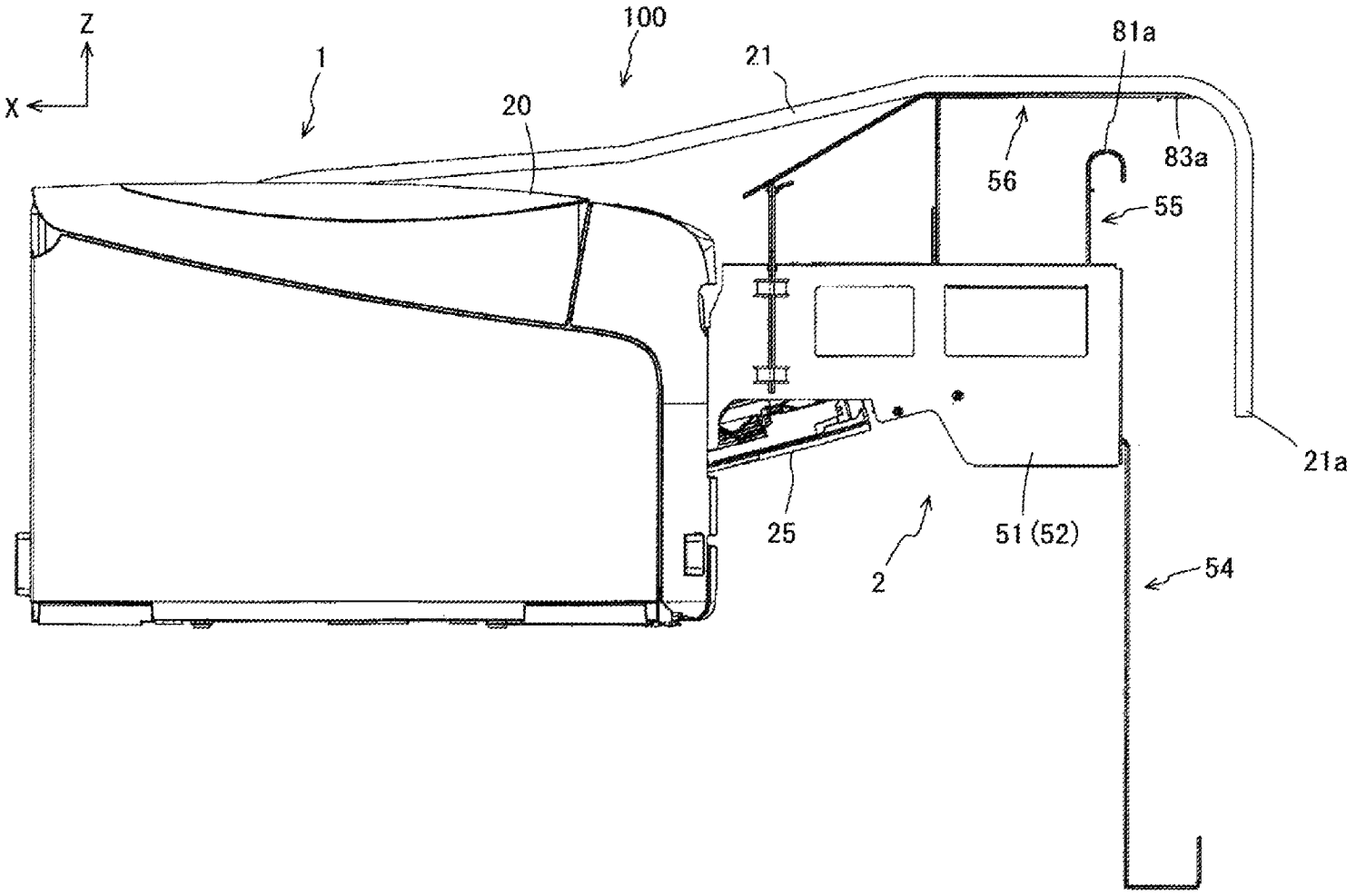
FIG. 7 is a state explanatory view that shows a state where printing is performed onto all long sheets in pile set in the medium loading device and the long sheets are ejected from the image forming apparatus main body.
Figure 8:
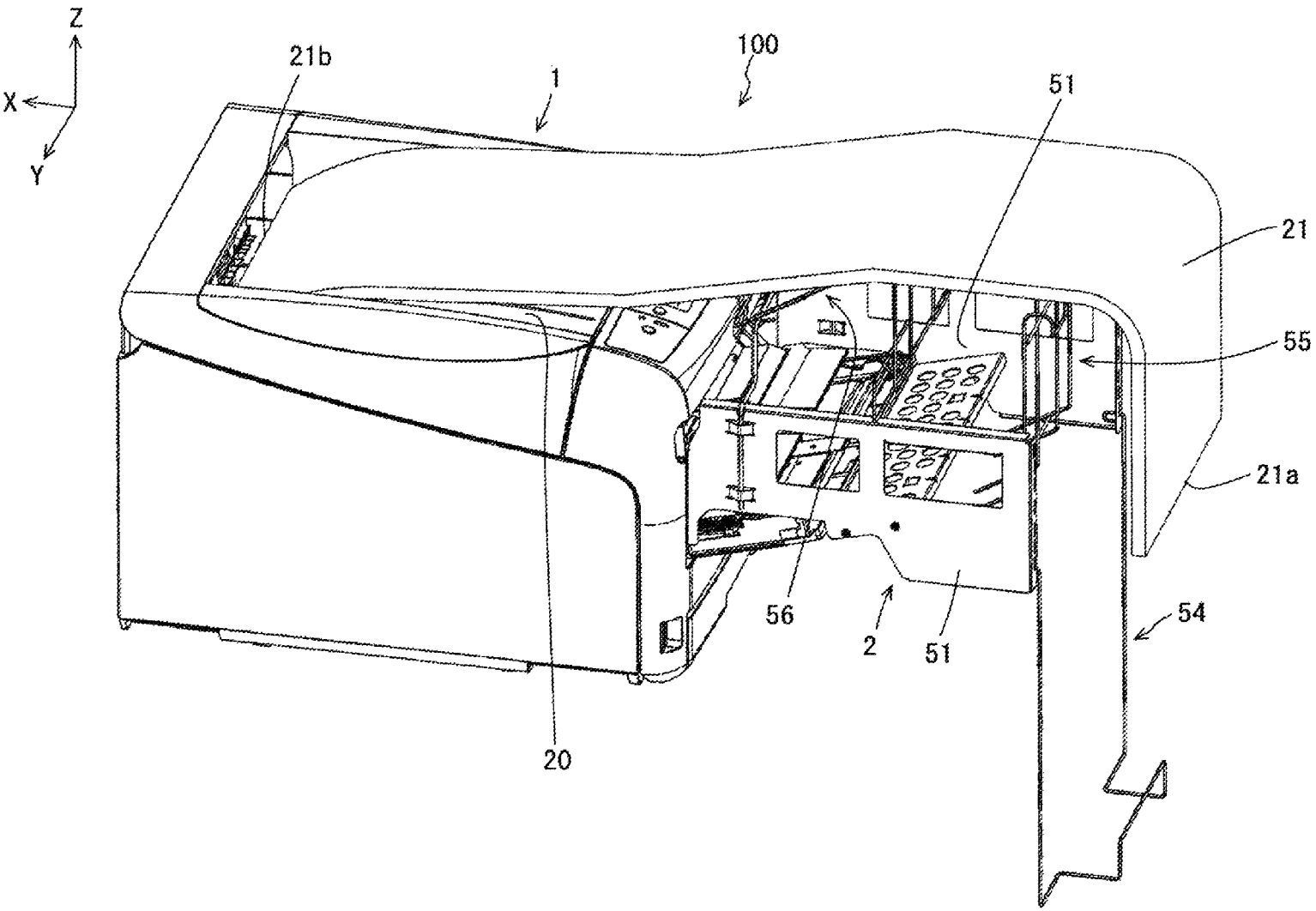
FIG. 8 is an appearance perspective view of the image forming apparatus in a state of FIG. 7, viewed from an obliquely upper part.

FIG. 7 is a state explanatory view that shows a state where printing has been performed onto all sheets of the pile of the long sheets 21 set in the medium loading device 2 and the long sheets have been ejected from the image forming apparatus main body 1. FIG. 8 is an appearance perspective view of the image forming apparatus 100 in the state of FIG. 7, viewed from an obliquely upper part.

The front end part 21*a* of the long sheet 21 printed by the image forming device main body 1 and ejected onto the stacker part 20 moves onto the loading guide part 83*a* of the third guide 56 of the medium loading device 2 via an upper portion of the stacker part 20, is suspended vertically downward from a front end part of the loading guide part 83*a*, and the movement stops and the long sheet 21 is loaded on the loading guide part 83*a* when the rear end part 21*b* is ejected onto the stacker part 20.

At this time, the printed long sheet 21 is positioned above the front end guide part 81*a* of the second guide 55 as illustrated in FIG. 7 and also positioned on the loading guide part 83*a* of the third guide 56, the loading guide part 83*a* being extended farther toward the side (X axis minus side) opposite to the image forming apparatus main body 1 than the front end guide part 81*a*. As a result, the printed long sheet 21 doesn't contact the long sheet 21 to be printed set in the medium loading device 2.

Note, it is preferred to extend an end part of the loading guide part 81*a* of the third guide 56 on the image forming apparatus main body 1 side to the vicinity of the stacker par 20 as needed such that a carrying path that is almost connected to the stacker part 20 of the image forming apparatus main body 1.

As described above, with the medium loading device 2 of the present embodiment, friction among sheets of the pile of the long sheet 21 set in the medium loading device 2 is reduced and this reduces a load during sheet supply, and as a result a stable sheet traveling during sheet supply is achieved.

Second Embodiment

Figure 9:
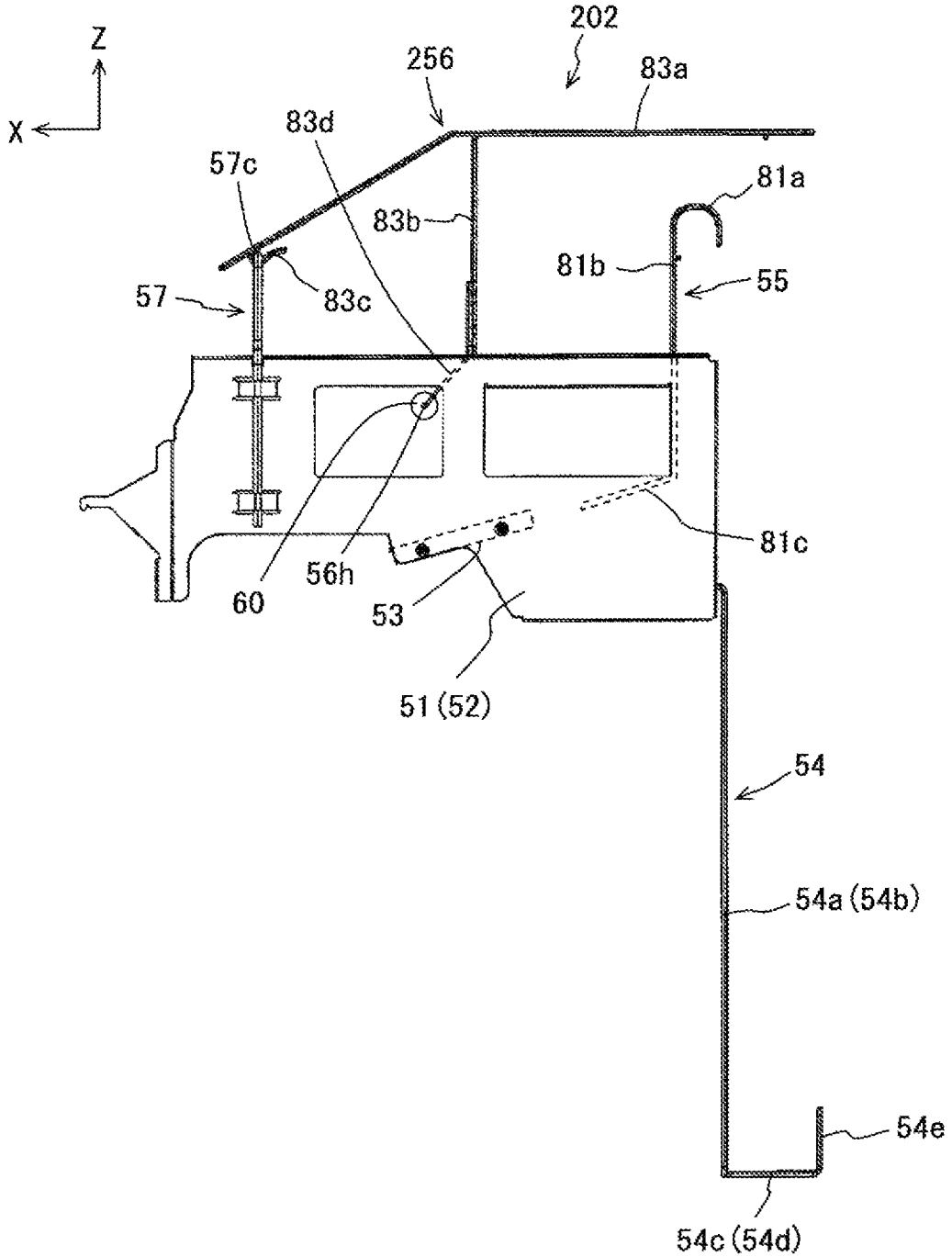
FIG. 9 is a side view of a medium loading device according to a second embodiment.
Figure 10:
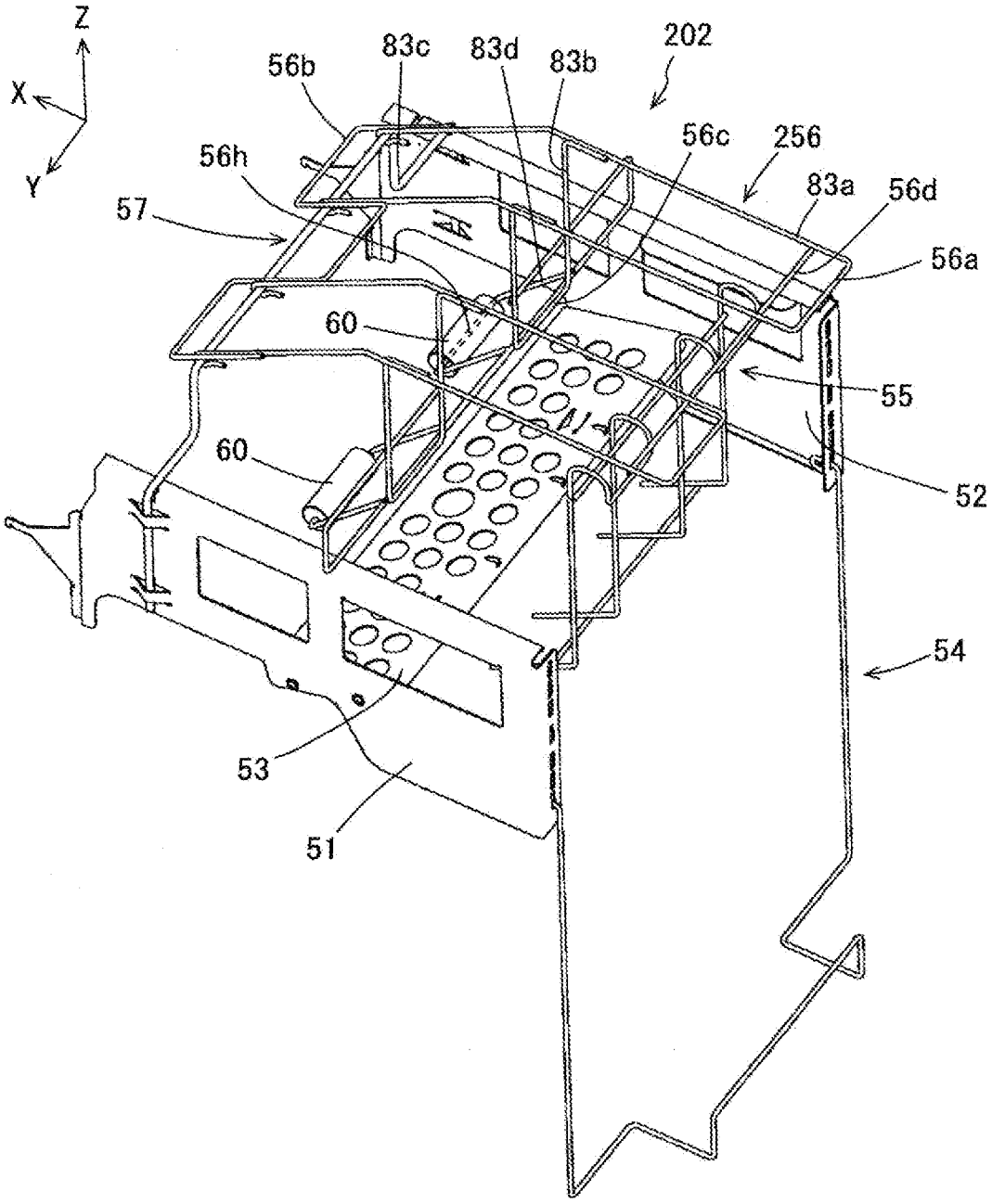
FIG. 10 is an appearance perspective view of the medium loading device according to the second embodiment.

FIG. 9 is a side view of a medium loading device 202 according to a second embodiment. FIG. 10 is an appearance perspective view of the medium loading device 202 according to the second embodiment.

A main deference between an image forming apparatus that adopts the medium loading device 202 and the image forming apparatus that adopts the medium loading device 2 according to the first embodiment illustrated in FIG. 2 is that a pair of guide rollers 60 is provided in a third guide 256. The same reference numbers are given to elements of the image forming apparatus that adopts the medium loading device 202 that are common with those of the image forming apparatus 100 according to the first embodiment, and/or drawings and explanation of those are omitted. Elements that different from the first embodiment are focused and explained. Note, except for the third guide 256, configurations of main elements of the image forming apparatus according to the present embodiment are in common with the configurations of main elements of the image forming apparatus according to the first embodiment, so FIG. 1 through FIG. 3 are referred as needed.

The third guide 256 is formed by a processed piece of a metallic cylinder shape member, and has a configuration that four guide pieces 83 are arranged in the width direction of the base plate 53. The guide piece 83 is formed with the loading guide part 83*a* that bends to have a dog leg shape, the supporting part 83*b* formed in a right angle shape from an almost center part of the loading guide part 83*a*, a roller supporting part 83*d* extended obliquely downward from the tip end of the supporting part 83*b*, and the hook 83*c* provided at one end side of the loading guide part 83*a* in an integrated manner.

In the guide pieces 83, end parts of the loading guide parts 83*a*, tip end parts of the supporting parts 83*b*, and tip end parts of the roller supporting part 83*d* are respectively linked by the linkage parts 56*a*, 56*b*, and 56*c*, and a linkage shafts 56*h*. On the linkage shafts 56*h*, forming a pair, the guide rollers 60 as medium restriction parts that rotate around the linkage shafts 56*h* as rotation shafts are arranged. Furthermore, the guide pieces are fixed by the fixing bar 56*d* that is suspended over all of the guide parts 83 in the vicinity of the linkage part 56*a* and the fixing bar 56*e* that is suspended over all of the guide parts 83 in a position of laying on the linkage part 56*c*, and therefore the third guide 56 is formed in an integrated manner.

When the third guide 256 is at a reference revolve position illustrated in FIG. 9 and FIG. 10, the roller supporting part 83*d* is extended obliquely downward (on the image forming apparatus main body 1 side of the front end guide part 81*a* of the second guide 55) toward the image forming apparatus main body 1 side (X axis plus side) from the tip end part of the supporting part 83*b*, and supports a pair of the guide rollers 60 between the base plate 53 and the top of the front end guide part 81*a* of the second guide 55 with respect to the vertical direction.

Therefore, when sheet supply of the long sheet 21 set in the medium loading device 202 is started by the sheet supply roller 3, when tension caused by friction generated between the carried long sheet 21 and a long sheet 21 just above the carried long sheet 21 or the front end guide part 81*a* at the front end guide part 81*a* of the second guide 55, the long sheet 21 contacts the guide roller and is guided and carried.

Note, in the present embodiment, the guide rollers 60 are provided, however, not limited to those. Various embodiments may be applicable, and for example, a configuration that the long sheet 21 directly contacts a rotation shaft of the guide roller 60 such as the linkage shaft 56*h* working as a guide part may be applicable.

As described above, according to the medium loading device 202 of the present embodiment, even when tension is generated to the long sheet 21 between the sheet supply roller 3 and the front end guide part 81*a* of the second guide 55, the long sheet 21 contacts the guide roller 60 and is guided and carried, so that smooth carrying without giving damages on the long sheet 21 is achieved.

In the embodiments described above, an example of the present invention in which a printer is used as the image forming apparatus has been shown. However, the present invention is not limited to the example, and image forming apparatus such as copier, facsimile, etc. are also applicable.

Regarding the sheet or media of the present invention, there is no restriction on quality, size or material. The medium may be bond paper, recycled paper, gloss paper, matte paper, over-head-projector (OHP) films, which is made of plastic, or the like. Further, in the application, the medium is disclosed as a sheet with a certain length, but the medium may be a roll, being fed by cut one sheet by one sheet.

What is claimed is:

1. A medium loading device that is arranged adjacent to an image forming apparatus that includes a medium supply roller that carries a medium, comprising:

a medium guide part that has a guide surface along which the medium is guided toward the medium supply roller, and is arranged on an upstream side of the medium supply roller in a medium carrying direction;

a medium end contact part that is arranged on an upstream side of the medium guide part in the medium carrying direction, is positioned below the guide surface of the medium guide part in the vertical direction, and is configured to contact an medium upstream end of the medium so that a portion of the medium is upwardly supported when the medium upstream end of the medium contacts the medium end contact part.

2. The medium loading device according to claim 1, further comprising:

a medium supporting part that is arranged between the medium guide part and the medium end contact part in the medium carrying direction, and that protrudes upwardly, wherein the medium supporting part includes a contact part at a top of the medium guide part so that the medium, which is to be supplied to the medium supply roller, is lifted by the medium supporting part.

3. The medium loading device according to claim 2, further comprising:

a medium loading part that is positioned above the medium guide part and the contact part with predetermined space to load another medium thereon.

4. The medium loading device according to claim 2, further comprising:

a medium restriction part that is positioned on an image forming apparatus main body side of the medium supporting part between the guide surface and the contact part with respect to the vertical direction, and is contactable to the medium.

5. The medium loading device according to claim 4, wherein the medium restriction part is a guide roller that contacts the medium and rotates along with carriage of the medium.

6. The medium loading device according to claim 2, wherein a distance between the medium supply roller and the contact part is shorter than a length of the medium along the medium carrying direction.

7. The medium loading device according to claim 6, wherein the distance between the medium supply roller and the contact part is ranged within 40% to 70% of the length of the medium.

8. The medium loading device according to claim 2, wherein the medium supporting part is supported by the medium guide part.

9. The medium loading device according to claim 2, wherein the contact part of the medium supporting part is configured with a plurality of substantial half-arcs, which are formed by folding stick like members, the arcs being arranged with an interval in a width direction of the medium.

10. The medium loading device according to claim 9, wherein the medium end contact part is formed by folding a stick like member, and the medium end contact part is detachable to the medium loading device.

11. The medium loading device according to claim 1, wherein the medium end contact part is configured to be adjustable in the vertical direction so that a height of the medium end contact part varies.

12. The medium loading device according to claim 1, further comprising:

a pair of side plates that supports both end parts of the medium guide part in a width direction of the medium, and a shaft that is arranged between the side plates in the width direction of the medium, wherein the medium loading part is rotatably supported by the shaft so that the medium loading part rotates around the shaft.

13. The medium loading device according to claim 1, further comprising:

a medium contact holding part that extends along the medium carrying direction such that the medium end contact part is arranged at a distal end of the medium contact holding part, wherein the medium contact holding part is adjustably in height supported by a pair of side plates that supports both end parts of the medium guide part in a width direction of the medium.

14. An image forming system, comprising:

an image forming apparatus that includes an image forming part to form a developer image on a medium that is carried in a medium carrying direction, and a medium loading device that is arranged adjacent to the image forming apparatus that includes a medium supply roller that carries the medium, the medium loaded in the medium loading device being carried to the image forming apparatus, wherein the medium guide part that has a guide surface along which the medium is guided toward the medium supply roller, and is arranged on an upstream side of the medium supply roller in the medium carrying direction;

a medium end contact part that is arranged on an upstream side of the medium guide part in the medium carrying direction, is positioned below the guide surface of the medium guide part in the vertical direction, and is configured to contact an medium upstream end of the medium so that a portion of the medium is upwardly supported when the medium upstream end of the medium contacts the medium end contact part.

15. The medium loading device according to claim 14, further comprising:

a medium supporting part that is arranged between the medium guide part and the medium end contact part in the medium carrying direction, and that protrudes upwardly, wherein the medium supporting part includes a contact part at a top of the medium guide part so that the medium, which is to be supplied to the medium supply roller, is lifted by the medium supporting part.

16. The medium loading device according to claim 14, wherein the contact part of the medium supporting part is configured with a plurality of substantial half-arcs, which are formed by folding stick like members, the arcs being arranged with an interval in a width direction of the medium.

17. The medium loading device according to claim 16, wherein the medium end contact part is formed by folding a stick like member, and the medium end contact part is detachable to the medium loading device.

18. The medium loading device according to claim 14, wherein the medium end contact part is configured to be adjustable in the vertical direction so that a height of the medium end contact part varies.

19. The medium loading device according to claim 14, further comprising:

a pair of side plates that supports both end parts of the medium guide part in a width direction of the medium, and a shaft that is arranged between the side plates in the width direction of the medium, wherein the medium loading part is rotatably supported by the shaft so that the medium loading part rotates around the shaft.

20. The medium loading device according to claim 14, further comprising:

a medium contact holding part that extends along the medium carrying direction such that the medium end contact part is arranged at a distal end of the medium contact holding part, wherein the medium contact holding part is adjustably in height supported by a pair of side plates that supports both end parts of the medium guide part in a width direction of the medium.

* * * * *